US008245351B2

(12) United States Patent
Rosenzweig et al.

(10) Patent No.: US 8,245,351 B2
(45) Date of Patent: Aug. 21, 2012

(54) FABRIC PAD FOR A STEAM MOP

(75) Inventors: Mark Rosenzweig, Chestnut Hill, MA (US); Maximilian Rosenzweig, Montreal (CA); Ognjen Vrdoljak, Laval (CA)

(73) Assignee: Euro-Pro Operating LLC, Newton, MA (US)

( * ) Notice: Subject to any disclaimer, the term of this patent is extended or adjusted under 35 U.S.C. 154(b) by 1049 days.

(21) Appl. No.: 12/185,507

(22) Filed: Aug. 4, 2008

(65) Prior Publication Data

US 2010/0024146 A1 Feb. 4, 2010

(51) Int. Cl.
*A47L 13/00* (2006.01)

(52) U.S. Cl. ..... 15/320; 15/403; 15/49.1; 15/97.1; 15/98; 15/228; 15/229.7; 15/229.8

(58) Field of Classification Search ..... 15/320, 15/403, 49.1, 97.1, 98, 228, 229.7, 229.8; *A47L 13/00*
See application file for complete search history.

(56) References Cited

U.S. PATENT DOCUMENTS

| | | | | |
|---|---|---|---|---|
| 1,496,045 | A * | 6/1924 | Wolford | 15/210.1 |
| 1,720,165 | A | 7/1929 | Bloom | |
| 1,864,886 | A * | 6/1932 | Bihler | 15/229.14 |
| 2,053,282 | A | 9/1936 | Gewalt | |
| 4,073,030 | A | 2/1978 | Albishausen | |
| 4,074,387 | A | 2/1978 | Arato et al. | |
| 4,327,459 | A | 5/1982 | Gilbert | |
| 4,584,736 | A | 4/1986 | Gremminger | |
| 4,698,871 | A * | 10/1987 | Patkos | 15/118 |
| 4,905,712 | A | 3/1990 | Bowlin et al. | |
| 5,165,866 | A | 11/1992 | Kato | |
| 6,289,551 | B1 | 9/2001 | Basile | |
| 6,490,753 | B1 | 12/2002 | Chen | |
| 6,571,421 | B1 | 6/2003 | Sham et al. | |
| 6,810,554 | B2 * | 11/2004 | McKay | 15/228 |
| 7,380,307 | B2 | 6/2008 | Tsai | |
| 7,487,567 | B2 * | 2/2009 | Kresse et al. | 15/228 |
| 2002/0094285 | A1 | 7/2002 | Paolini et al. | |
| 2002/0106970 | A1 | 8/2002 | Falla | |
| 2002/0112744 | A1 | 8/2002 | Besseling | |

(Continued)

FOREIGN PATENT DOCUMENTS

CH 429 211 A 1/1967

(Continued)

OTHER PUBLICATIONS

Patent Abstracts of Japan, vol. 2002, No. 03, Apr. 3, 2002, Publication No. 2001327449 (Alpha Homes: KK), Nov. 21, 2001.

(Continued)

*Primary Examiner* — David Redding
(74) *Attorney, Agent, or Firm* — Wolf, Greenfield & Sacks, P.C.

(57) ABSTRACT

A steam pad for use with a steam mop is provided. The fabric steam pad comprises at least one cleaning fabric layer, and a corresponding layer of fabric where the fabric layers are joined around the perimeter. The fabric steam pad has at least one fastener band secured to the mesh fabric in a position to correspond to at least one fastener anchored on the steam mop frame and increased structural stability of the pad to avoid buckling of the fabric at the edges. A warp knit mesh layer may be disposed on the fabric surface opposed to the cleaning surface.

6 Claims, 7 Drawing Sheets

U.S. PATENT DOCUMENTS

| | | | | |
|---|---|---|---|---|
| 2003/0089383 | A1 | 5/2003 | Biggs | |
| 2004/0134016 | A1 | 7/2004 | Kisela | |
| 2006/0000049 | A1 | 1/2006 | Rosenzweig | |
| 2006/0000241 | A1 * | 1/2006 | Rosenzweig | 68/5 R |
| 2006/0123573 | A1 | 6/2006 | Rivera et al. | |
| 2007/0050938 | A1 | 3/2007 | Rosenzweig | |
| 2007/0130719 | A1 | 6/2007 | Zhou | |
| 2008/0066789 | A1 | 3/2008 | Rosenzweig | |

FOREIGN PATENT DOCUMENTS

| | | | |
|---|---|---|---|
| CN | 1368032 | A | 9/2002 |
| CN | 2540155 | Y | 3/2003 |
| CN | 2568117 | Y | 8/2003 |
| DE | 24 31 102 | A1 | 1/1976 |
| DE | 91 10 171 | U1 | 3/1993 |
| DE | 298 22 052 | U1 | 2/1999 |
| DE | 299 10 658 | U1 | 9/1999 |
| DE | 200 01 462 | U1 | 1/2001 |
| DE | 200 17 627 | U1 | 2/2001 |
| DE | 100 15 941 | A1 | 10/2001 |
| DE | 102 05 507 | A1 | 8/2003 |
| DE | 10 2004 039516 | A1 | 2/2006 |
| DE | 20 2006 001189 | U1 | 4/2006 |
| EP | 0 927 536 | A1 | 7/1999 |
| EP | 1 027 855 | A | 8/2000 |
| EP | 1 224 899 | A | 7/2002 |
| EP | 1 238 621 | A1 | 9/2002 |
| EP | 1 554 968 | A | 7/2005 |
| EP | 1 818 434 | A1 | 8/2007 |
| FR | 601 312 | A | 2/1926 |
| FR | 709 689 | A | 8/1931 |
| FR | 2 282 252 | A | 3/1976 |
| FR | 2 877 204 | A3 | 5/2006 |
| GB | 1 449 483 | | 8/1973 |
| GB | 2 294 196 | A | 4/1996 |
| GB | 2 416 526 | A | 2/2006 |
| JP | 2001327449 | A | 11/2001 |
| JP | 2004337454 | A | 12/2004 |
| WO | WO 98/23385 | A | 6/1998 |
| WO | WO 99/26522 | A | 6/1999 |
| WO | WO 02/43550 | A | 6/2002 |
| WO | WO 2007/065371 | A | 6/2007 |

OTHER PUBLICATIONS

Euro-Pro Operating LLC; Steam Shark II Owner's Manual Model EP908EF; Nov. 2003; St. Laurent, Quebec H4S 1A7, pp. 1-39.

Euro-Pro Operating LLC; Portable Shark Steam Cleaner Owner's Manual Model SC505; Jan. 2003; p. 7; Champlain, NY 12919, pp. 1-11.

International Search Report and Written Opinion for PCT/US2009/036455 mailed Jun. 9, 2009.

International Preliminary Report on Patentability for PCT/US2009/036455 mailed Sep. 16, 2010.

* cited by examiner

FABRIC PAD FOR A STEAM MOP

BACKGROUND OF THE INVENTION

The invention relates generally to steam mops, and more particularly to a fabric steam pad for use with a steam mop.

Conventional mops have been widely used for cleaning floors. However, conventional mops have not been effective at cleaning dirt in small crevices and floor gaps. In addition, conventional mops require frequent rising since mops can only effectively clean a small surface area at a time.

Steaming devices used to apply steam to household objects are well known. The uses of the devices vary widely, and may include the application of steam to drapes or other fabrics to ease wrinkles, and the application of steam to objects to assist in cleaning the objects.

Typical steam devices have a reservoir for storing water that is connected to an electrical water pump with an on/off switch. The exit from the electric water pump is connected to a steam boiler with a heating element to heat the water. The heated water generates steam, which may be directed towards its intended destination through a nozzle which controls the application of the steam. Variation of the shape and size of the nozzle allows for preferred distribution of generated steam to an object to be cleaned. The nozzles may be disconnectable from the steam generator to allow different nozzles to be utilized, based on the object to be steamed. The nozzle may be either closely coupled to the steam generator, or located at a distance from the steam generator, requiring tubing or other steam transfer structures to be interconnected between the steam generator and the discharge nozzle. Typically, it is beneficial to provide suitable connectors between the steam generator and the nozzle to allow either the nozzle to be connected to the steam generator, or to allow the interpositioning of transfer tubes or hoses between the steam generator and the nozzle.

In general, the nozzles used with the steam cleaners do not have large surface areas and a cloth to absorb the liquid condensate of the steam. Often steam injected behind the cloth passes through the cloth at the points the bristles contact on the cloth. This tends to wet the cloth and reduce the cleaning effectiveness of the steam. In addition, the cloth covers must be carefully attached so as to not to cover the front or back of the brush attachment.

Notwithstanding the wide variety of steam generating appliances and accessories available, it is desirable to provide an efficient steam mop pad that will improve the steaming surface area of the steam cleaners and provide the necessary venting of steam to avoid formation of excess liquid steam condensate when cleaning flooring and other surfaces.

SUMMARY OF THE INVENTION

Generally speaking, in accordance with the invention, a multilayer fabric steam pad to be mounted on a steam pad frame of a steam mop is provided. The fabric steam pad includes at least two substantially planar fabric layers having a cleaning layer and a backing layer with at least one fastener region secured to the backing layer for removeably attaching the pad to the steam frame. The fastener may be a conventional hook-and-loop fastener, commonly known as "Velcro." In a preferred embodiment a mesh layer is joined to the fabric backing layer on the outer surface opposite from the cleaning layer.

In another embodiment, the fabric steam pad is shaped to conform to the profile of the steam frame and is somewhat larger than the footprint and extends between about 5.0 to 25 mm on each edge of the frame to avoid buckling of the fabric during use and to keep the perimeter of the fabric dry. This also allows the fabric to help dry the cleaned surface by absorbing excessive steam condensation. The fabric has some dimensional stability imparted by the various layers so that it may be easily attached and removed from the frame. The pad includes at least two fabric layers and may include a corresponding mesh layer with all the layers of fabric joined around the perimeter. At least one section of a fastener material is positioned on a fabric layer opposite the cleaning surface and stitched through the fabric layers. When the fastener is Velcro, the hooks are mounted on a ribbon that is stitched through the layers to provide additional stiffness to the pad. The pad may be any geometric shape, such as rectangular, circular or triangular that corresponds to the shape of the steam frame.

Accordingly, it is an object of the invention to provide a fabric steam pad that is easily mounted on and removed from a steam pad frame.

Yet a further object of the invention is to provide a steam pad frame attachment for a fabric pad that allows steam to penetrate the fabric layers and yet escape at the edges to provide sufficient venting to avoid condensation behind the pad.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which.

DETAILED DESCRIPTION OF THE INVENTION

Figure 1:
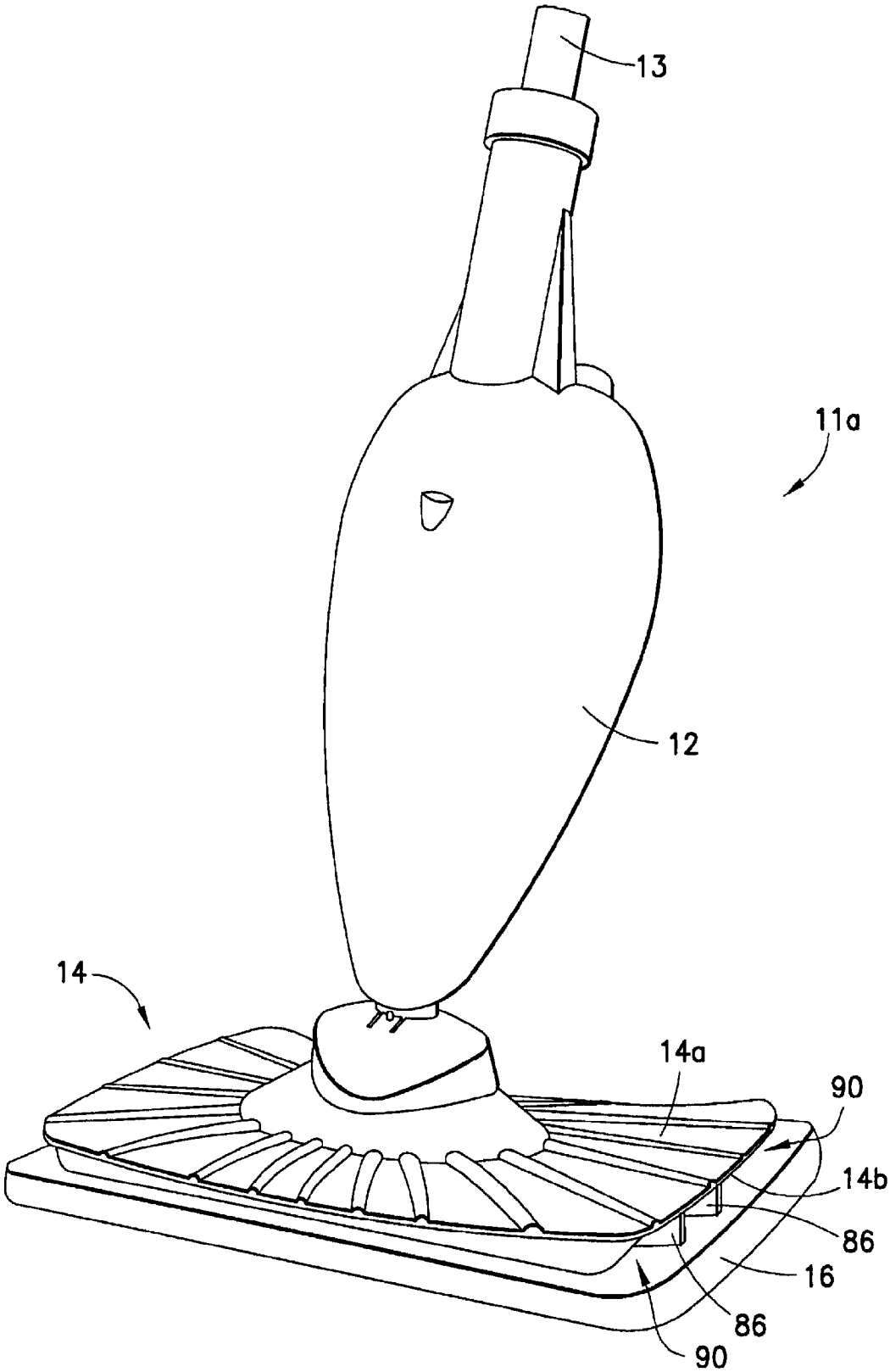
FIG. 1 is a perspective view of steam mop housing and steam frame including a fabric steam pad constructed and arranged in accordance with the invention.
Figure 6:
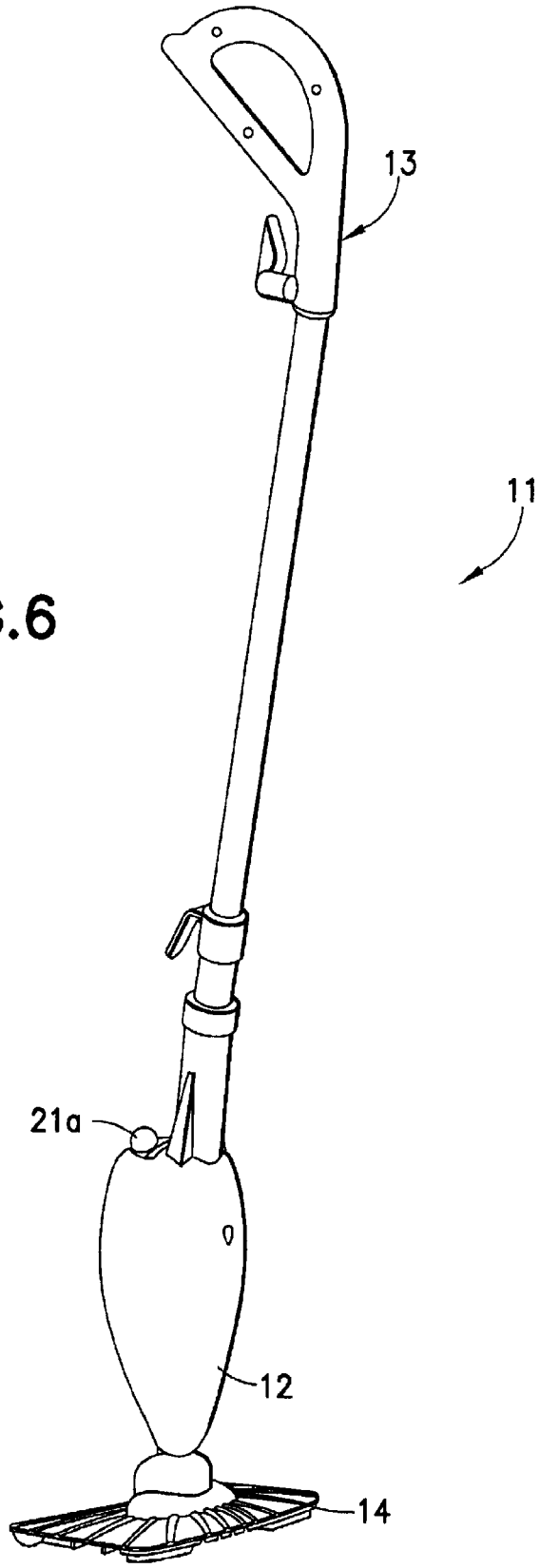
FIG. 6 is a perspective view of a push-pull floor steam mop including a housing and steam frame as shown in FIG. 1.

FIG. 1 is a perspective view of the lower end 11*a* of a steam mop 11 (as shown in FIG. 6) having an elongated housing 12 with a connecting pole 13 at one end and a steam frame 14 at the opposite end. Steam frame 14 has a solid upper surface 14*a* and an opposed bottom cleaning surface 14*b* shown in detail in FIG. 4. A fabric steam pad 16 is removeably fastened to bottom cleaning surface 14*b*.

Figure 7:
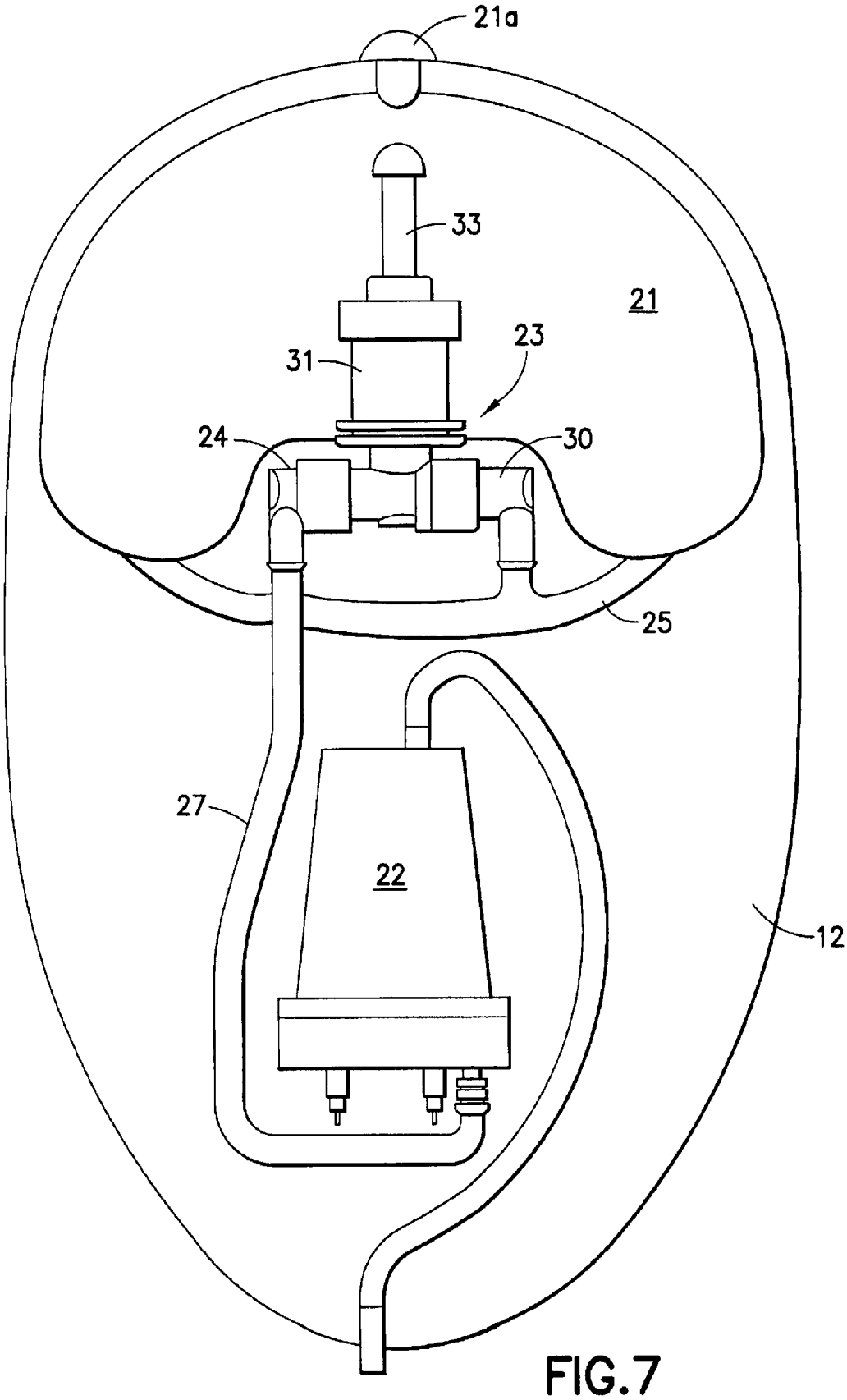
FIG. 7 is a front plan view showing reservoir, pump and boiler in the steam mop housing.
Figure 8:
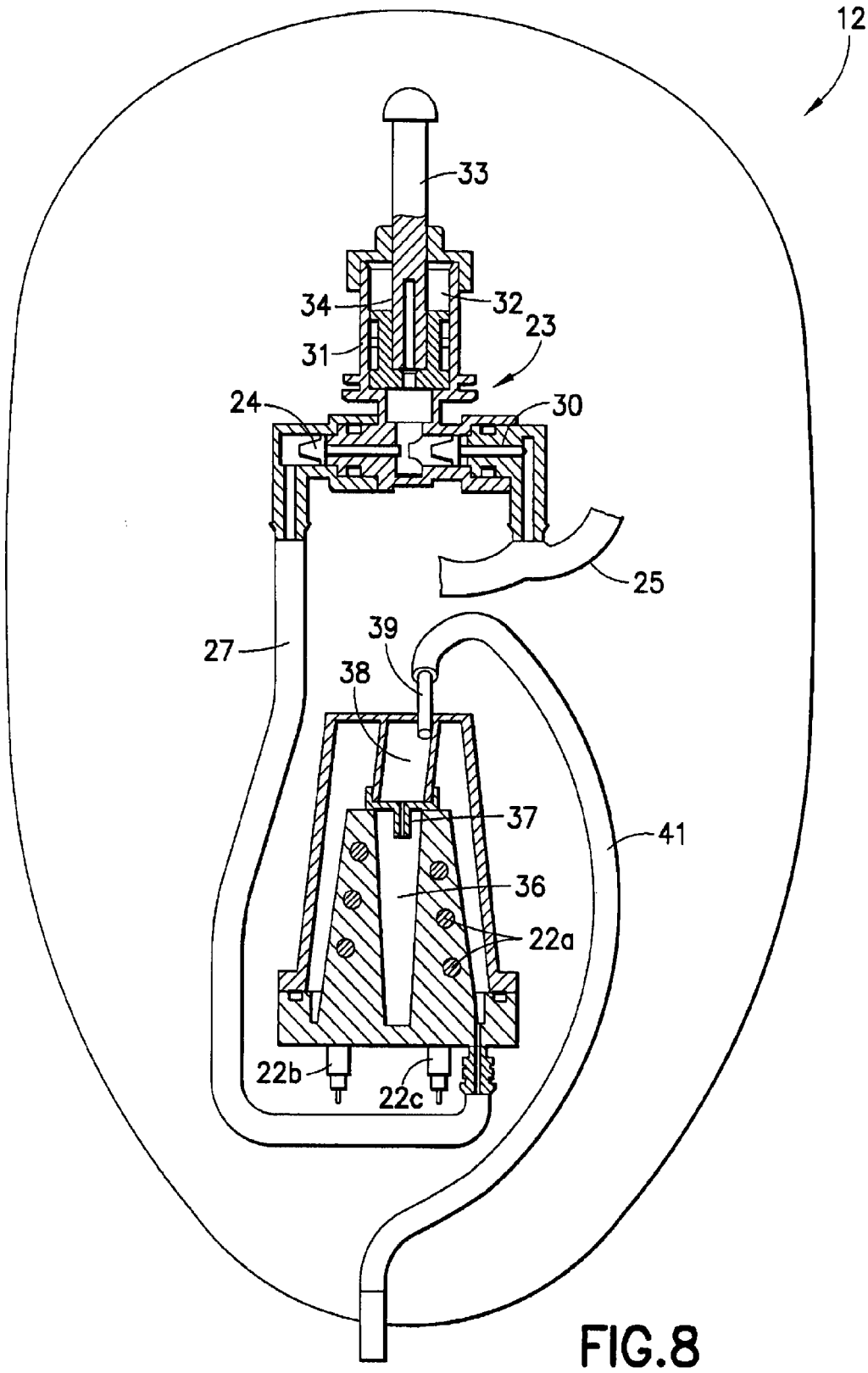
FIG. 8 is a cross-sectional view of the principal elements of FIG. 7.

Mop housing 12 includes a water container or tank 21 as shown in FIGS. 7 and 8 connected to a boiler 22 by a pump 23 having a one-way outlet valve 24. Any type of mechanical pump or some other means of transporting the water to the boiler may be used with steam mop 11. Preferably, pump 23 is a mechanical pump, such as a bellows pump or a piston pump, that is actuated by movement of mop 11 by a user pushing and pulling handle 13. Alternatively, the water may be fed by an electronic pump that pumps in response to a motion sensor, a pressurized, or a drip pump.

Figure 2:
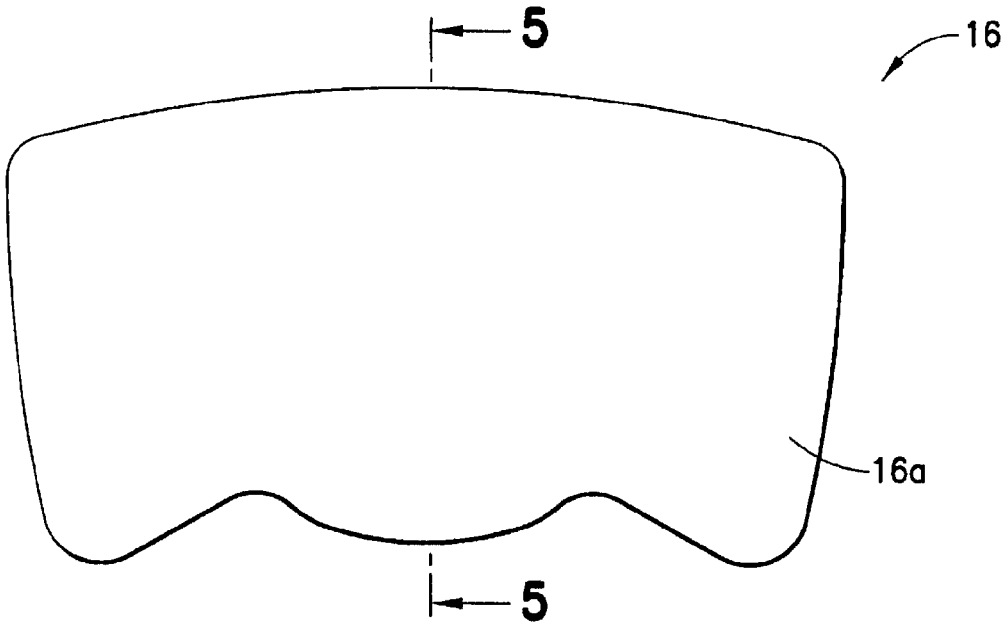
FIG. 2 is a plan view of the outside cleaning surface of the fabric steam pad in accordance with the invention.
Figure 3:
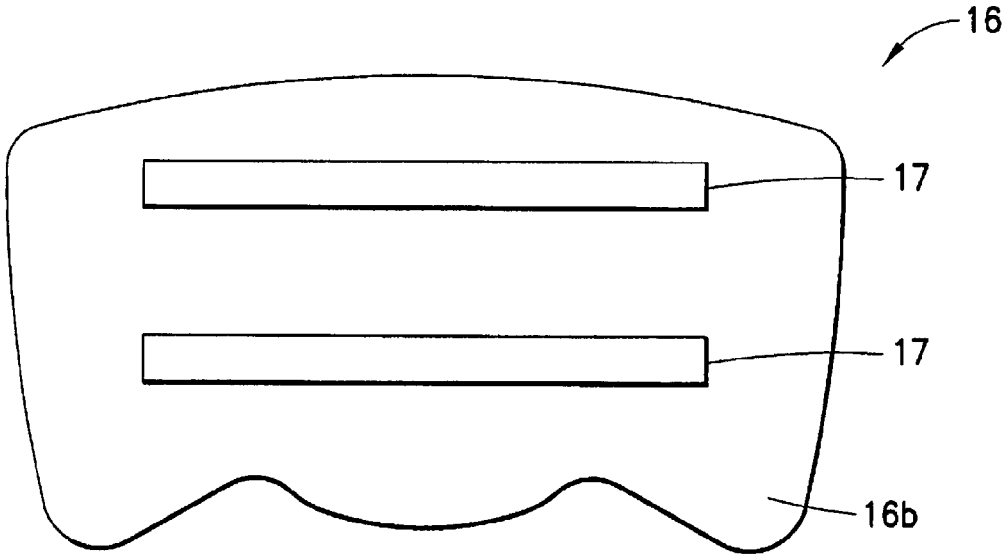
FIG. 3 is a plan view of the upper surface of the fabric steam pad of FIG. 2 showing hook-and-loop fastening bands on the upper surface.

Referring now to FIG. 2, steam pad 16 constructed and arranged in accordance with the invention has a lower cleaning surface 16*a* and an upper fastening surface 16*b*. As shown in FIG. 3, fastening surface 16*b* has a pair of hook and loop fastening bands 17 mounted thereon. Fastener bands 17 are secured to the fabric layers of pad 16 by stitching along the edges there of through the fabric layers. Fastener bands 17 impart some structural stiffness to the fabric layers as described below. Steam pad 16 is attached to steam frame bottom surface 14*b* by fastener bands 17 as described below in connection with FIG. 4.

Figure 4:
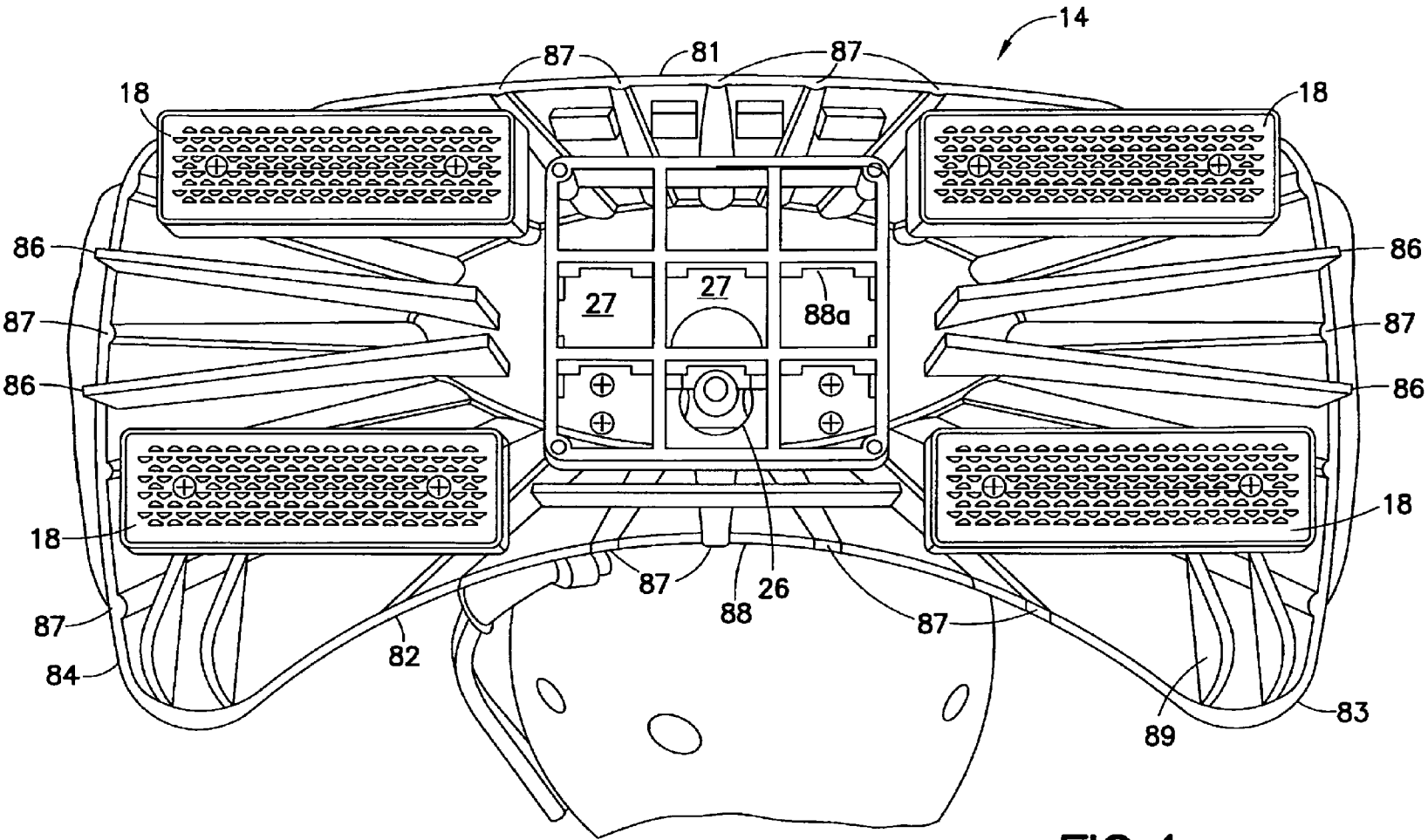
FIG. 4 is a plan view of the bottom cleaning surface of the steam frame of the mop in FIG. 1.

A plan view of the bottom cleaning surface 14*b* of steam frame 14 of the steam mops 11 is shown in FIG. 4. Steam pad frame 14 is substantially rectangular in shape and includes a central steam opening 26 and cavity 27. Steam generated in steam boiler 22 dispenses steam into frame 14 through central steam opening 26 of frame 14 into cavity 27. Here, bottom of steam frame 14*b* includes four hook-and-loop fastener receiving elements 18 to be attached to fastener bands 17 on upper surface 16*a* of steam pad frame 14. Steam frame 14 includes a front wall 81, a rear wall 82, a right side wall 83 and a left side wall 84. Bottom surface 14*b* of steam frame 14 includes a plurality of vanes 86 extending from steam opening 26 and cavity 27 to the edge of frame 14 and grooves 87 in frame bottom surface 14*b* and feet 89. Vanes 86 extend about 50 to 150 mm above frame bottom surface 14*b*. Vanes 86 help disperse the steam uniformly throughout frame 14 when in use and allow for venting of steam between fabric pad 16 and frame bottom surface 14*b*. Feet 89 also provide leveling and stability when mopping. In use steam is released from beneath steam pad 16 at the edge of frame 14 when steam pad 16 is attached to steam frame 14. Vanes 86 extend between about 5 to 15 mm above the bottom solid surface of bottom 14*b* so that open spaces 90 between fabric pad 16 and frame 14 operate as vents to release steam before it condenses and wets the fabric layers of pad 16.

Figure 5:
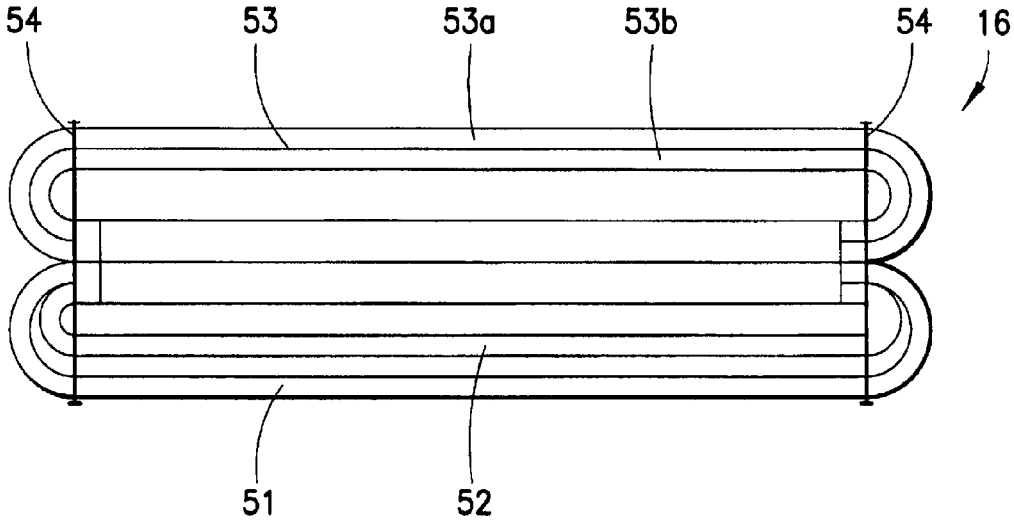
FIG. 5 is a cross-sectional view of the fabric steam pad across line 5-5 of FIG. 2.

FIG. 5 is a cross-sectional view of fabric steam pad 16 constructed and arranged in accordance with a preferred embodiment of the invention taken along line 5-5. Fabric steam pad 16 has a first lower fabric cleaning layer 51 that faces the surface to be cleaned and a corresponding second upper fabric layer 52, with a mesh layer 53 disposed on the outer surface of upper layer 52. Upper fabric layer 52 is placed against first fabric layer 51 and both layers are turned and mesh layer 53 is turned and then all layers are stitched along this periphery at a hemline 54. Fastener bands 17 are stitched through the three layers of fabric at stitch lines 57. In another embodiment, fastener bands 17 are stitched or glued or fused to mesh layer 53. Fastener bands 17 are ribbons of Velcro receiving fasteners with hooks 18 adhered to a ribbon 19. This provides stiffness to pad 16. In this embodiment, fabric steam pad 16 is substantially rectangular; however, it may be any convenient geometric shape, such as a triangle or circle.

Fabric layers 51 and 52 are velour fabrics and may be the same construction or different. Mesh layer 53 is a warp knit fabric having an exterior layer, fishnet construction 53*a* and an interior more tightly knit layer 53*b* fused together. Fastener bands 17 are disposed on fishnet surface 53*a* and attached to pad 16 by stitches 57.

In the illustrated embodiment, steam pad 16 is a cloth or towel. It may be formed of any suitable fabric such as cotton or a synthetic fabric, such as polyester, acrylic, polyamide or polyolefin fiber. Generally, steam pad 16 is formed from two layers of microfiber polyester fabric or blend and one mesh layer stitched about the perimeter.

In a preferred embodiment of the invention, first fabric layer 51 and second fabric layer 52 are a velour microfiber material. Mesh layer 53 is a two-layer warp knit fused together with exposed layer 53*a* having a fish net appearance and inner 53*b* layer a tighter knit. All the layers are turned and joined about the perimeter by a seam 54. Fastener bands 17 are disposed on mesh layer 53 and stitched through the three layers of fabric steam pad 16 by a seam 57. Preferably, the fabric of pad 16 is a microfiber. Most preferably, the microfiber is a synthetic polyester or polyester and polyamide blend microfiber. This fabric steam pad is substantially rectangular; however, it may be any convenient geometric shape, such as a triangle or circle. First fabric layer 51 and second fabric layer 52 formed of a microfiber, such as a polyester microfiber have two velour surfaces. Fasteners 17 are a Velcro-type fastener.

FIGS. 7 and 8 are a front plan and sectional views, respectively, of the elements in housing 12 of steam mop 11. Housing 12 includes a water container or tank 21, connected to a one-way pump 23 and a boiler 22. A pump water supply hose 25 is connected to a one-way inlet valve 30. A pump water outlet 24 is connected to boiler 22 through a boiler water supply hose 27. Water container 21 includes an opening 21*a* that may be easily opened and closed for the user to fill mop 11 with water.

Water pump 23 includes a pump body 31 having a pump cavity 32. A piston 33 connected to a push rod 34 is positioned in cavity 32. As mop handle 13 is pulled by a user, push rod 34 and piston 33 create a negative pressure in cavity 32. This draws water from tank 21 into pump water supply hose 25 and into one-way inlet valve 30. As handle 13 is pushed during use, water in cavity 32 is expelled through one-way outlet valve 24. This pumped water then passes to boiler 22. Water in boiler 22 is heated by a heating element 22*a* in a boiler cavity 36 and steam generated is fed through a steam valve 37 into a steam chamber 38. Heating element 22*a* is connected to electrical connectors 22*b* and 22*c*. Steam is then expelled through a steam outlet 39 to a steam hose 41 and to frame nozzle 16.

One-way inlet valve 30 and one-way outlet valve 24 in the illustrated embodiment are formed of a flexible elastomeric material, such a rubber. The valves are conical in shape so that when handle 13 is pulled, water is drawn through inlet valve 30 while outlet valve 24 remains closed. Similarly, when handle 13 is pushed, water is forced out through outlet valve 24 and inlet valve 30 remains closed and water is fed into boiler 22. One-way inlet and outlet valves can have a wide variety of designs. For example, they may be designed with small sealing plates and a spring or a ball bearing and spring as is well known in the art.

Figure 9:
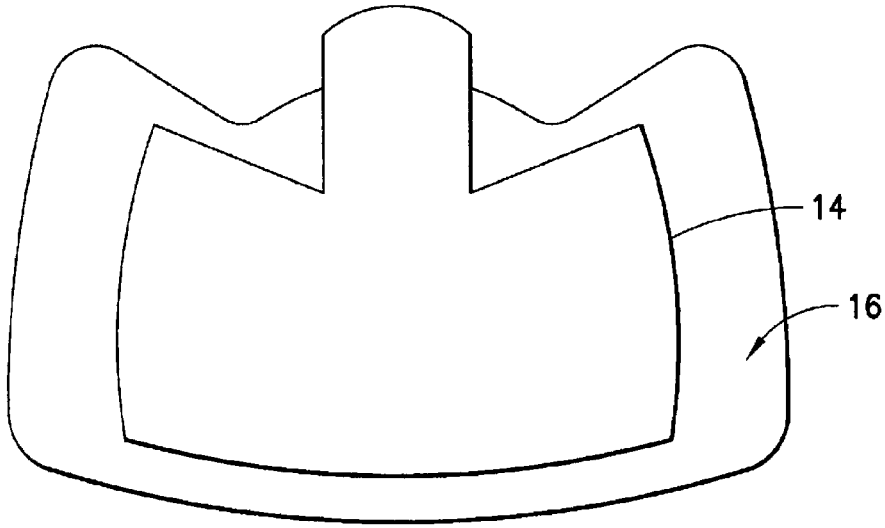
FIG. 9 is a top plan view of the mop of FIG. 1 with a fabric steam pad mounted on the steam frame.

FIG. 9 is a perspective view of the mop of FIG. 1 as a floor mop with fabric steam pad 16 mounted on steam frame 14. Fabric steam pad 16 is attached to steam pad frame 14 by fasteners (not shown). Also, in this example, fabric steam pad is larger than steam pad frame to provide increased steam cleaning surface area.

EXAMPLES

The following are examples of fabric steam pads constructed and arranged in accordance with the invention, but are not intended to be presented in a limiting sense.

1. Pad 1 is 70% polyester, 30% nylon and weights 1.4 oz per square yard, but can vary from 0.5 to 3.0 ounces per yard. The first and second fabric layer is made of terry and has a density of 266-273 loops per square inch. The third mesh layer is made of a warp knit having an exterior layer and an interior layer fused together where the density of the interior layer is 15 knits per inch from left to right, 25 knits from top to bottom and the exterior layer is 4 knits per inch from left to right, 6 knits from top to bottom.

2. Pad 2 is 100% polyester and weights 1.6 oz per square yard. The first and second fabric layer is made of terry and has a density of 221-240 loops per square inch. The third mesh layer is made of a warp knit having an exterior layer and an interior layer fused together where the density of the interior layer is 25 knits per inch from left to right, 18 knits from top to bottom and the exterior layer is 6.5 knits per inch from left to right, 5 knits from top to bottom.

3. Pad 3 is 100% polyester and weights 1.6 oz per square yard. The first and second fabric layer is made of terry and has a density of 286-299 loops per square inch. The third mesh layer is made of a warp knit having an exterior layer and an interior layer fused together where the density of the interior layer is 17.5 knits per inch from left to right, 25 knits from top to bottom and the exterior layer is 4.5 knits per inch from left to right, 6 knits from top to bottom.

4. Pad 4 is 100% polyester and weights 1.6 oz per square yard. The first and second fabric layer is made of terry and has a density of 260-273 loops per square inch. The third mesh layer is made of a warp knit having an exterior layer and an interior layer fused together where the density of the interior layer is 12 knits per inch from left to right, 24.5 knits from top to bottom and the exterior layer is 3.5 knits per inch from left to right, 5.75 knits from top to bottom.

Thus, fabric layers 51 and 52 may be between 0.5 to 3 or 4 ounces per square yard and have velour surfaces on one or both surfaces of varying density. Mesh layer is a warp knit having an exterior fishnet knit layer and an interior layer facing with at least one fastener section on the fishnet knit surface corresponding to the fastener anchor on the bottom surface of the steam mop frame.

The dimensions of the pad depend on the dimensions of the steam mop frame and the type of boiler used. The dimensions chosen for the fabric steam pad preferably provides sufficient dry steam at suitable moisture content and temperature based on the boiler used in the steam mop.

Steam floor mop 11 provides many advantages for ease of use. Here, the user has more control over the amount of water needed to be discharged into the boiler and consequently, how much steam is needed by moving the mop forward and backwards. The stiffness of the pad in combination with the space between the fabric and bottom of steam frame due to the Velcro hooks and ribs provides for venting of steam around all edges of the steam frame. The steam mop is designed as a low pressure or non-pressurized system so it is safer for the user to use with the amount of water routed to the boiler controlled, so that the boiler can create steam in a short period of time.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

The present invention may be embodied in other specific forms without departing from the spirit or essential attributes of the invention. Accordingly, reference should be made to the appended claims, rather than the foregoing specification, as indicating the scope of the invention. A steam pad frame attachment with a fabric pad cover in accordance with the invention provides a vast improvement over placing a towel onto a bristle attachment for a steam cleaned. It avoids puncture of the cloth by the bristles. Moreover, the fabric cover is easily installed and replaced.

What is claimed is:

1. A steam mop, comprising:

a steam generator;

a steam frame to receive steam from the steam generator and to support a selectively removable fabric steam pad;

a fabric steam pad that allows steam to penetrate and including a velour cleaning surface;

a layer of mesh fabric opposed to the cleaning surface, wherein the mesh fabric is a warp knit; and wherein the warp knit includes an outer fishnet surface knit and an inner layer of more densely knit fabric with the two knit layers bonded together.

2. The steam mop of claim 1, wherein the fabric steam pad is substantially rectangular in shape.

3. The steam mop of claim 1, wherein the steam pad includes a hook-and-loop fastener to fasten the steam pad to the steam frame.

4. The steam mop of claim 1, wherein the fabric steam pad is formed from a microfiber.

5. The steam mop of claim 4, wherein the microfiber is a polyester.

6. The steam mop of claim 4, wherein the microfiber is a polyester blend.

* * * * *